United States Patent [19]

Lazaro, Jr. et al.

[11] Patent Number: 4,981,446

[45] Date of Patent: Jan. 1, 1991

[54] MODULAR, CIRCULAR, ENVIRONMENT RESISTANT ELECTRICAL CONNECTOR ASSEMBLY

[75] Inventors: Luis J. Lazaro, Jr., Renton; Franklin D. Harsch, Seattle, both of Wash.

[73] Assignee: The Boeing Company, Seattle, Wash.

[21] Appl. No.: 432,429

[22] Filed: Nov. 6, 1989

[51] Int. Cl.[5] ..... H01R 13/40

[52] U.S. Cl. ..... 439/589; 439/275; 439/587

[58] Field of Search ..... 439/589, 587, 275, 279, 439/281, 521, 712, 349

[56] References Cited

U.S. PATENT DOCUMENTS

| | | | |
|---|---|---|---|
| 2,824,290 | 2/1958 | Archer et al. | 439/275 |
| 3,349,364 | 10/1967 | Paullus et al. | 439/589 |
| 3,404,364 | 10/1968 | Paullus et al. | 439/589 |
| 3,851,296 | 11/1974 | Muchmore et al. | 439/589 |
| 4,281,887 | 8/1981 | Luca, Jr. | 439/589 |
| 4,492,421 | 1/1985 | Ito | 439/587 |
| 4,725,242 | 2/1988 | Sonobe et al. | 439/589 |
| 4,740,176 | 4/1988 | Marko et al. | 439/589 |
| 4,810,209 | 3/1989 | Punako et al. | 439/589 |
| 4,871,328 | 10/1989 | Wright et al. | 439/589 |

*Primary Examiner*—Paula A. Bradley

*Attorney, Agent, or Firm*—C. O. Gardner; B. A. Donahue

[57] ABSTRACT

An electrical connector modularly arrayed for ease in manual and automatic fabrication and assembly of wire bundle assemblies. Increased structural strength, elimination of snap ring, straight bore inside diameter, the addition of an insert alignment key, and elimination of electrical contact retention clips are features of the present modular electrical connector assembly.

. 3 Claims, 2 Drawing Sheets

MODULAR, CIRCULAR, ENVIRONMENT RESISTANT ELECTRICAL CONNECTOR ASSEMBLY

BACKGROUND OF THE INVENTION

This invention relates to circular electrical connectors and more particularly to a circular electrical connector assembly resistant to hostile, external ambient environments.

Past efforts have been precluded due to high cost of connector assemblies brought on by technical problems associated with the contact insertion process of the assemblies due to e.g.:

uncontrolled (different) insertion depth of various types of circular connectors;

great difficulty in indexing hole patterns of the connectors;

problems associated with the use of filler rods and spare contacts;

the diversity of contact styles and sizes; and, the presence of tolerance variation between the connector grommet and dielectric.

Current processes in connector assembly typically include: stripping wires, crimping electrical contacts to the wires, and inserting the contacts into the connector and installing backshell hardware. In summary, the connector assembly can best be described as an individual segment of the wire bundle assembly which includes stripping, crimping, and insertion. Assembly of the electrical contacts to the connector requires the use of insertion tools (loading) or extraction tools (removal). The close proximity of the electrical contacts and the diversity in contact styles and sizes complicates this process. An added complexity is the requirement of the prevention of injury to the operator, viz., a device such as a vise is required to hold down the connector before insertion of the contacts into the connector. Such arrangements and methods are tedious, labor intensive, and can result in rework if the coupling ring of the connector gets damaged in the clamping process.

SUMMARY OF THE INVENTION

Accordingly, it is an object of the present invention to provide a circular electrical connector which is resistant to undesirable external environmental conditions, and of modular configuration, which is compatible with automated design, manufacture, and assembly thereof.

A further object of the present invention includes a circular modular connector assembly characterized by elimination of the electrical contact insertion process and related tooling (insertion/extraction tools) used in the assembly of the connector thereby enabling simplified, cost effective automation and robotic fabrication and assembly of electrical/electronic wire bundle assemblies.

It is yet another object of the present invention to provide a circular modular type connector which is intermatable with prior connectors (such as type Mil-C-26500, Mil-C-83723, Mil-C-38999, and Mil-C-5015 connectors).

DETAILED DESCRIPTION OF THE INVENTION

Figure 1:
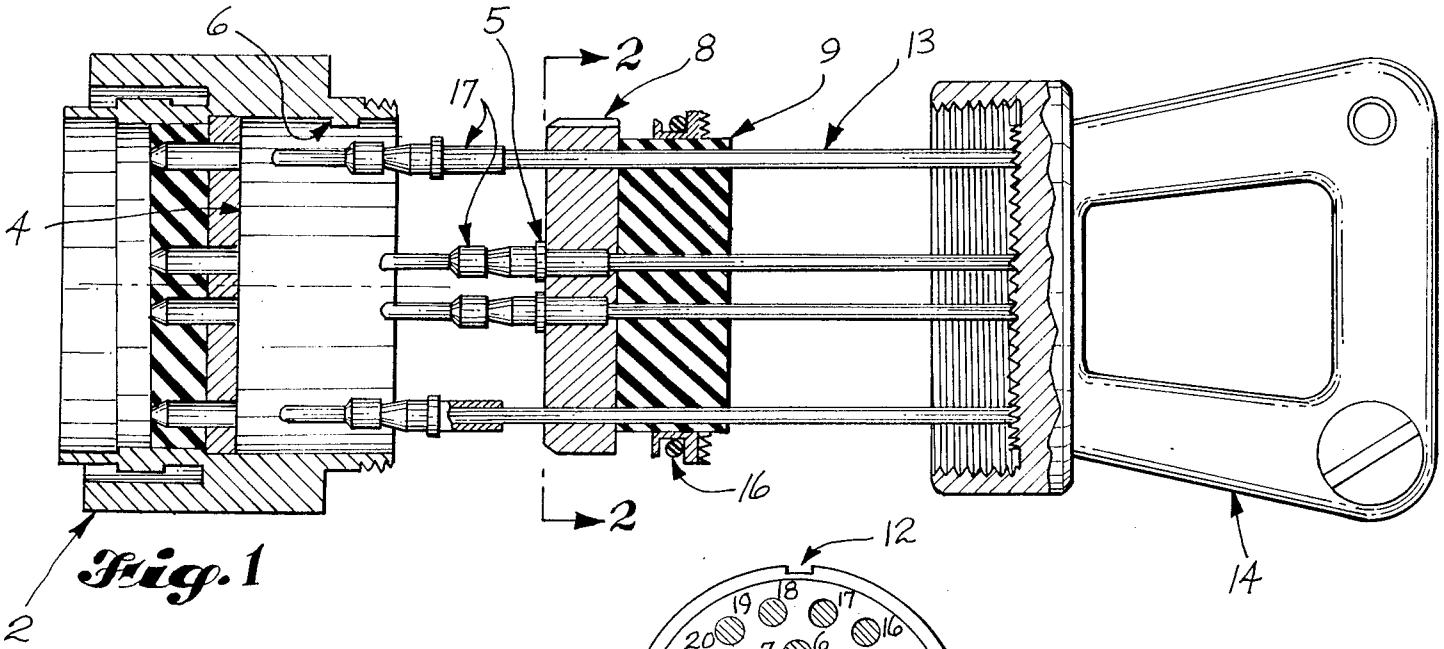
FIG. 1 is a cross sectional view which illustrate the assembly of the present modular connector, and included in the illustration is a connector cable clamp or backshell 14, and the further showing of a wired grommet assembly 3 being loaded onto a connector shell 2.
Figure 2:
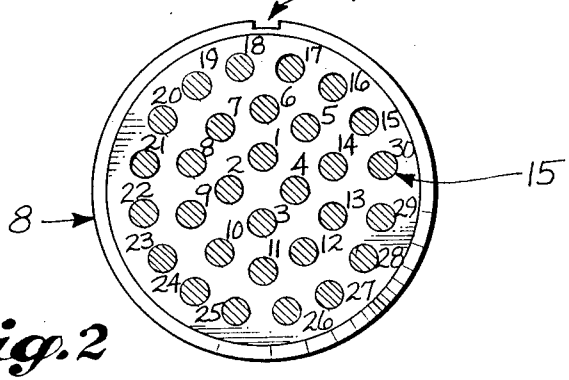
FIG. 2 is the end view (face) of the grommet dielectric 8 illustrating the insert arrangement of the connector of which individual holes 15 are numbered for proper wiring.
Figure 3:
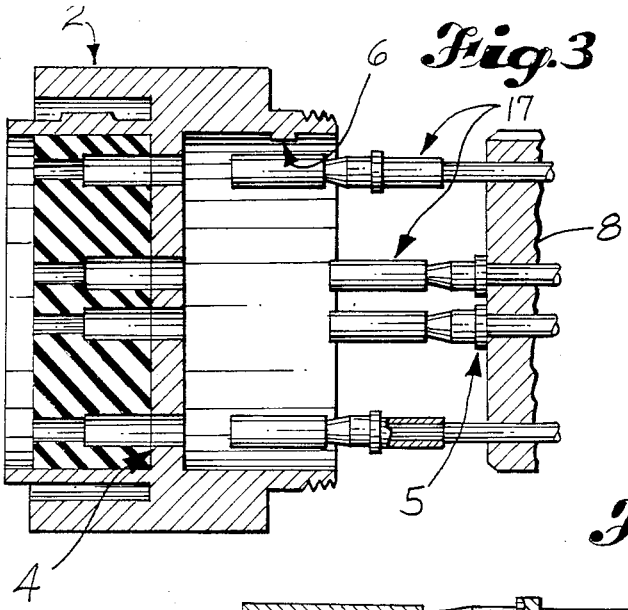
FIG. 3 is an illustration, similar to that shown in FIG. 1 but with components labeled, and wired electrical contacts 17 shown at their fixed location, i.e., contacts 17 are nested 5 against the grommet dielectric 8 face and wired contacts 17 are shown at their free length position.
Figure 6:
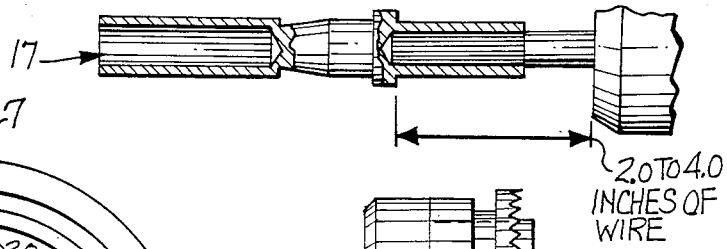
FIG. 6 is a cross section of wired electrical contacts 17 illustrating the requirement, for free wire length.
Figure 4:
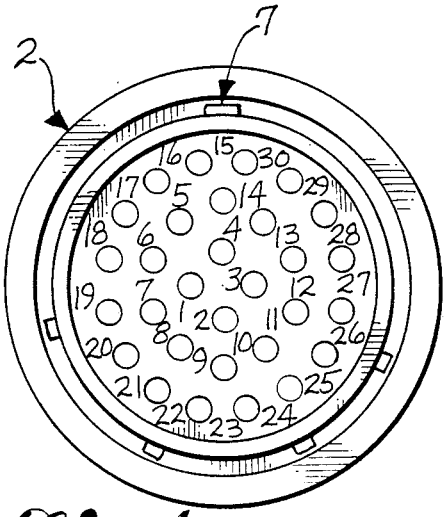
FIG. 4 is an end view of the connector further showing by way of illustration the plug or receptacle face. The master key on the plug or keyway 17 on the receptacle is highlighted.

The present electrical, circular, environment resisting connector utilizes a modular construction consisting of a connector shell 2 and a grommet assembly 3. Included in the illustration at FIG. 1 is a connector cable clamp or backshell 14 and a wired grommet assembly 3 being loaded onto a connector shell 2. FIG. 2 shows the grommet dielectric 8 illustrating insert arrangement of the connector of which individual holes are numbered 15 for proper wiring. In FIG. 3, wired electrical contacts 17 are shown at their fixed location, i.e., contacts are nested 5 against grommet dielectric 8 face. The master key (on the plug) or keyway (on the receptacle) 7 can be seen in FIG. 4. Wired electrical contacts 17 are shown in FIG. 6 illustrating the requirement for 2–4 inches of free wire length. The construction of the connector shell 2 is similar to the present Mil-C-26500, Mil-C-83723, Mil-C-38999 and Mil-C-5015 connectors with the following differences:

(1) The connector wall is about 0.020 inches thicker for improved strength;

(2) There is cut-down on thickness of dielectric 4;

(3) Snap ring which is used to hold down the insert assembly is eliminated;

(4) The inside diameter is simplified to a straight bore, and an alignment key 6 is added, the alignment key 6 being positioned directly on the opposite end of the master key or keyway 7 of the connector as shown in FIG. 4.

Figure 5:
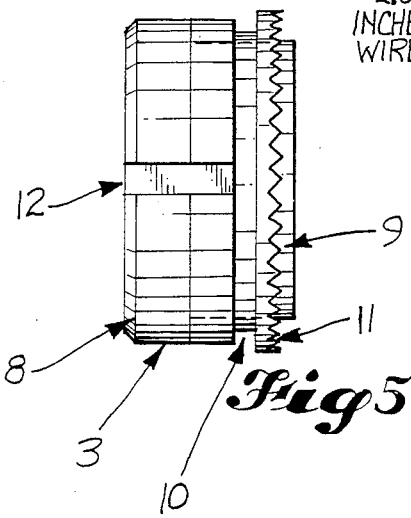
FIG. 5 is a side elevation of the grommet assembly 3.

The grommet assembly 3, as shown in FIG. 5, consists of a grommet dielectric 8, grommet 9 and a pressure ring 10 with an O-ring 16, 0.070 inches in diameter, for environmental sealing and MS 3155 accessory teeth 11 functioning as an integral part. The grommet assembly has a keyway 12 located at the same axis as the alignment key 6 on the connector shell 2. The alignment key 6 is designed to be dimensionally located with respect to the keyway 12 without much interference in order to reduce a potential wearing condition.

The assembly process (automatic or manual) includes the following method steps:

(A) Wires 13 (as required) are inserted through backshell hardware 14 (see FIG. 1).

(B) Push wires 13 through numbered holes 15 of the grommet assembly 3 with approximately 2–4 inches of free length (see FIG. 6).

(C) Strip all wires 13.

(D) Crimp electrical contacts 17 onto wires 13.

(E) Pull wire(s) 13 to nest contact shoulder 5 against grommet dielectric 8 portion of the grommet assembly 3.

(F) Align keyway 12 of grommet assembly 3 with alignment key 6 of the connector shell 2 and push grommet assembly 3 inside connector shell 2 until it bottoms. Contacts 17 can float (move) about 0.005 inches.

(G) Install backshell accessory 15 and apply torque as required.

Rework process (manual) is as follows:

(A) Loosen backshell accessory 15 and push back.

(B) Pull out grommet assembly 3.

(C) Push out wire(s) 13 (needed to be reworked) approximately 2–4 inches of free length from the face of the grommet assembly 3.

(D) Repeat steps C thru G (as required).

The present modular electrical connector assembly enables automated assembly and as can be seen from the preceding detailed description provides among others, the following features and advantages:

Elimination of the electrical contact insertion process and related tooling such as insertion and removal tools in the assembly of the connector.

Inhibits costly connector assembly on both labor and material waste.

Provides increased connector assembly reliability such as, elimination of unseated electrical components and others.

Enables improved operator (personnel) safety due to elimination of insertion tool.

We claim:

1. An electrical connector assembly comprising in combination:

a connector shell 2; and a grommet assembly 3; said grommet assembly 3 including a grommet dielectric 8, having a face position, grommet 9, and pressure ring 10 having an O-ring 16 for providing an environmental seal;

said connector shell 2 having an alignment key 6;

said grommet assembly 3 having a keyway 12 disposed on a common axis with said alignment key 6; and, a plurality of electrical contacts 17 nested against said face position of said grommet dielectric 8.

2. The electrical connector assembly according to claim 1 wherein each of said plurality of electrical contacts 17 includes a wire crimped thereto and coupled through said grommet assembly 3 to a backshell 14.

3. The electrical connector assembly according to claim 2 wherein said wire 13 has a free length of between about 2 to 4 inches.

* * * * *